US008266725B2

(12) United States Patent
Chiang

(10) Patent No.: US 8,266,725 B2
(45) Date of Patent: Sep. 18, 2012

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 1006 days.

(21) Appl. No.: 12/285,969

(22) Filed: Oct. 17, 2008

(65) Prior Publication Data

US 2010/0083426 A1 Apr. 8, 2010

(30) Foreign Application Priority Data

Oct. 3, 2008 (TW) ..... 97217789 U

(51) Int. Cl.
*A61F 9/02* (2006.01)

(52) U.S. Cl. ..... 2/448; 2/445; 2/452

(58) Field of Classification Search ..... 2/426, 439, 2/440, 442, 445, 446, 448, 452; 24/170, 24/173, 178, 191, 265 BC; 351/43, 156
See application file for complete search history.

(56) References Cited

U.S. PATENT DOCUMENTS 5,181,280 A * 1/1993 Zachry, Jr. ..... 2/452
6,350,030 B2 * 2/2002 Fujima ..... 351/43
7,146,653 B2 * 12/2006 Chou ..... 2/426
7,251,842 B1 * 8/2007 Chiang ..... 2/445
2006/0218757 A1 * 10/2006 Chou ..... 24/170
2007/0193004 A1 * 8/2007 Chou ..... 24/170
2007/0256283 A1 * 11/2007 Chiang ..... 24/193
2009/0205114 A1 * 8/2009 Chiang ..... 2/428

* cited by examiner

*Primary Examiner* — Khoa Huynh
*Assistant Examiner* — Sally Haden
(74) *Attorney, Agent, or Firm* — Cheng-Ju Chiang

(57) ABSTRACT

Swimming goggles include a left frame, a right frame, a connecting member connecting the left frame and the right frame, a strap mechanism assembled on outward sides of the left frame and the right frame, and control members. The strap mechanism includes a head strap defining a plurality of stop grooves therein. Each control member has an engaging portion for engaging with the left frame/the right frame, an operating portion formed opposite to the engaging portion, a pivot portion provided between the engaging portion and the operating portion, and a bias portion near a side of the operating portion for abutting against stop grooves of the head strap. The pivot portion abuts against the bases of the strap mechanism and drives the operating portion upward. When the operating portion is pushed inward, the bias portion displaces inward correspondingly and disengages from the stop grooves.

10 Claims, 6 Drawing Sheets

SWIMMING GOGGLES

BACKGROUND OF THE INVENTION

1. Field of the Invention

The present invention relates to swimming goggles, and particularly to swimming goggles which are worn comfortably and adjust a head strap thereof conveniently.

2. Related Art

Swimming goggles typically adjust length of a head strap thereof with buckles. Such a buckle generally has a profile of two neighboring square rings, and defines two slots. Two free ends of the head strap respectively extend through the slots and overlap with each other. During adjustment of the head strap, friction between the overlapped portion of the head strap will block movement of head strap.

Furthermore, conventional swimming goggles typically have control members on sides of frames thereof. The control members control engagement with/disengagement from predetermined stop grooves of a head strap so as to adjust length of a head strap thereof. In other words, the head strap can not be adjusted when the control members abut thereto; the head strap can be adjusted when the control members release. The control members return to initial state only by cooperation of resilient portions. So normally, two or three pieces are needed to implement this structure together. However, so many pieces of components are needed to form this structure, thus this structure requires high cost.

SUMMARY OF THE INVENTION

Accordingly, an object of the present invention is directed to provide swimming goggles which have simplified structure and are assembled easily and which adjust length of a head strap thereof easily.

The swimming goggles comprise a left frame, a right frame, a connecting member connecting the left frame and the right frame, a strap mechanism, and control members. Each of the left frame and the right frame has a frame body and an lens, the frame body forming a latch portion on an outward side thereof. The strap mechanism is assembled on the latch portions of the left frame and the right frame, and includes bases, positioning axes and a head strap. Each base forms lock portions for locking with the latch portions. The positioning axes are mounted on the bases. The head strap defines a plurality of stop grooves therein. The control members are respectively assembled on the latch portions of the left frame and the right frame, and abut against the bases of the strap mechanism. Each control member comprises an engaging portion for engaging with the latch portion of the left frame/the right frame, an operating portion formed opposite to the engaging portion, a pivot portion provided between the engaging portion and the operating portion, and a bias portion near a side of the operating portion for abutting against the stop grooves of the head strap. The pivot portion abuts against the bases of the strap mechanism. When the operating portion is pushed inward, the bias portion displaces inward correspondingly and disengages from the stop grooves. The operating portion has return force by deformation.

DESCRIPTION OF THE PREFERRED EMBODIMENTS

Figure 1:
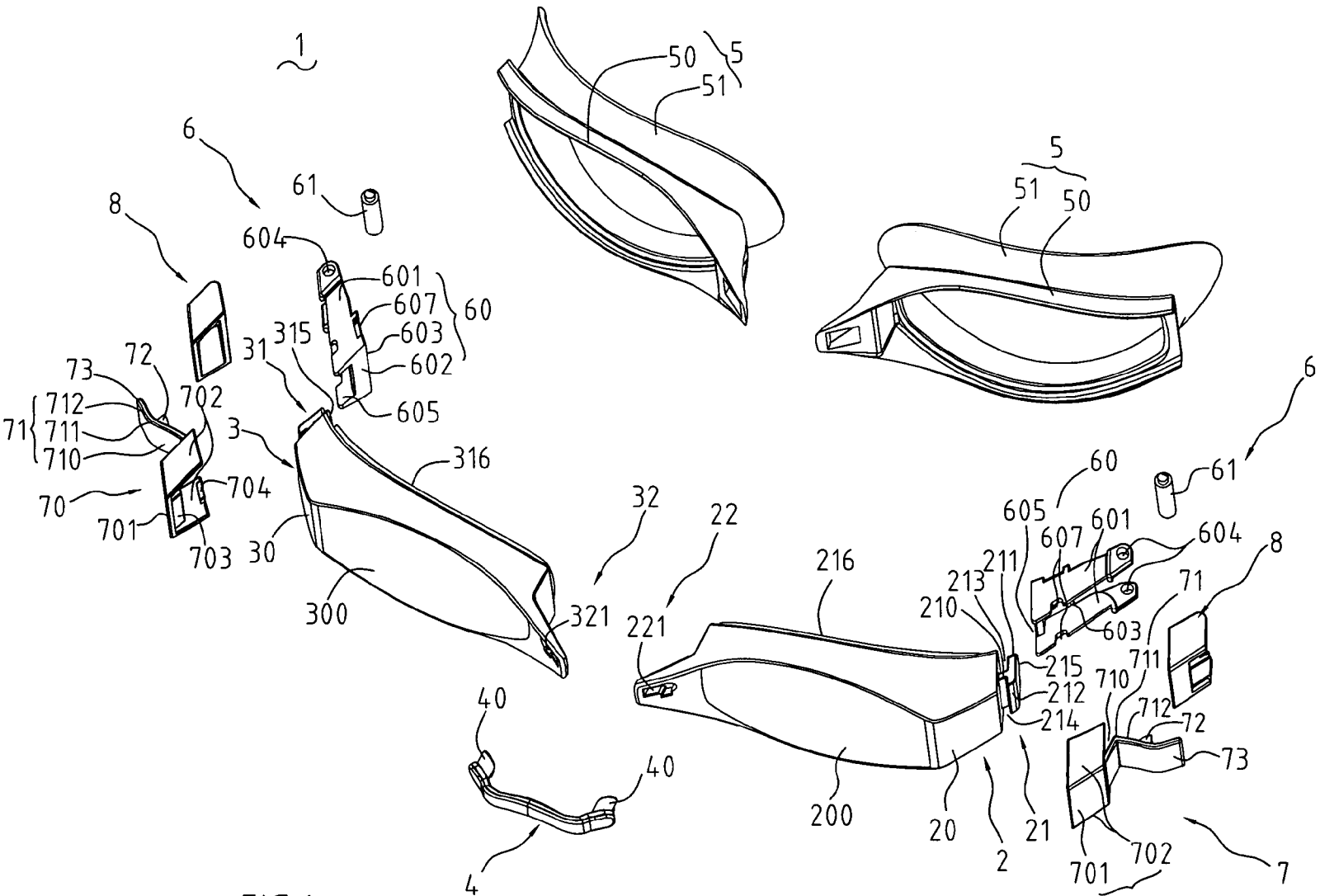
FIG. 1 is an exploded view of swimming goggles of the present invention.
Figure 2:
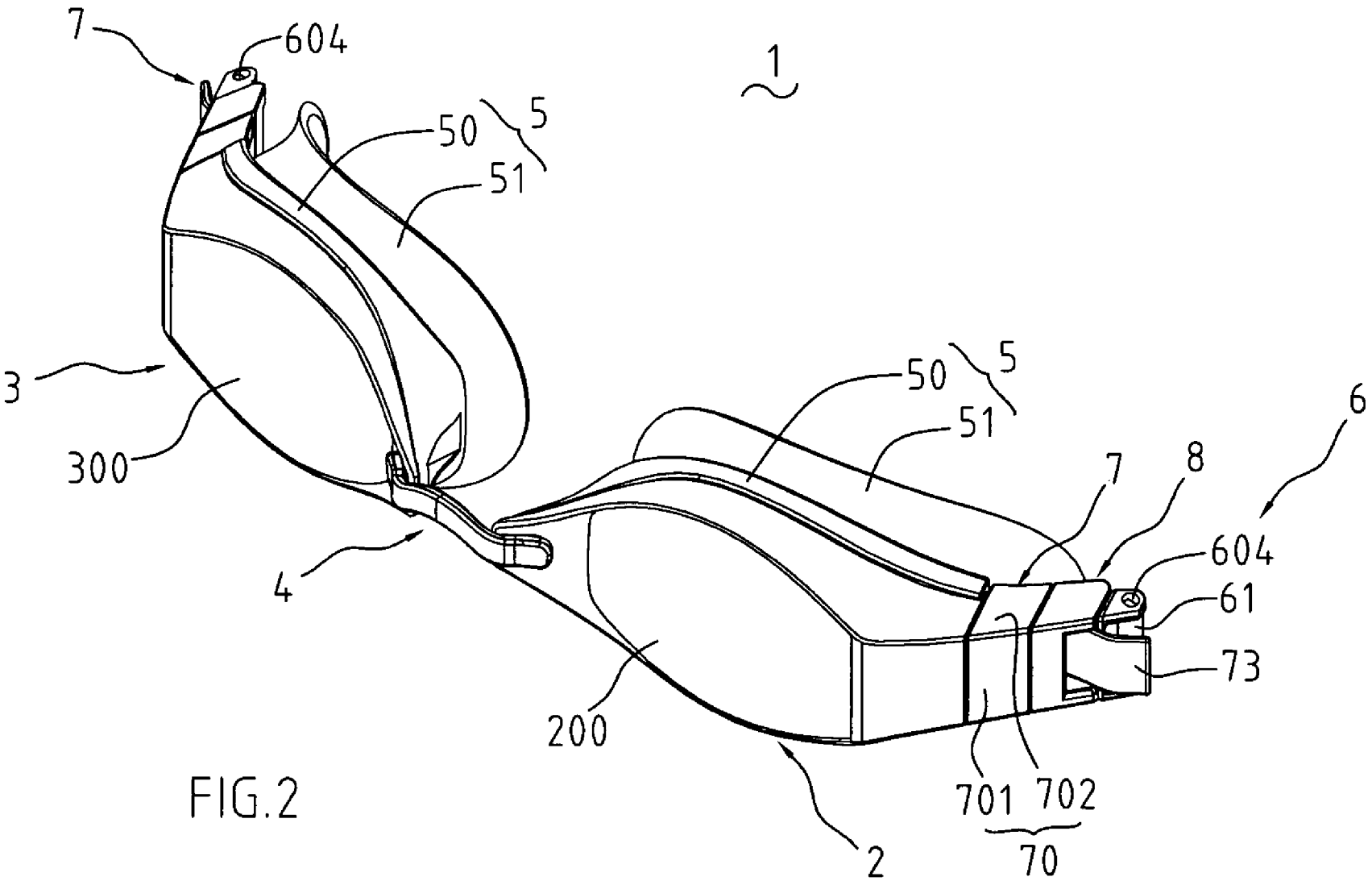
FIG. 2 is an assembled view of the swimming goggles of FIG. 1.
Figure 4:
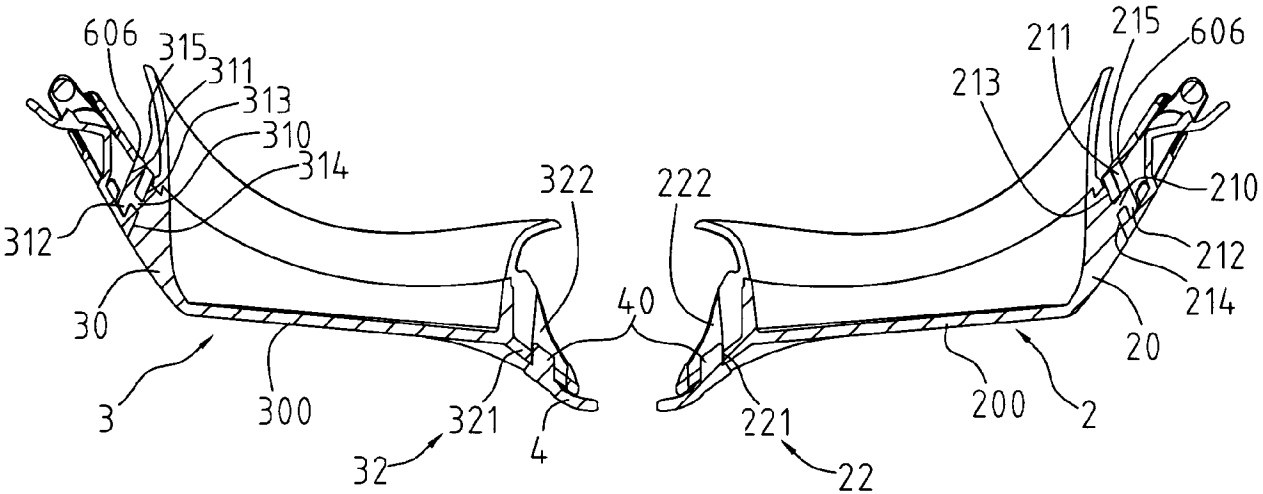
FIG. 4 is a cross-sectional view taken along the line 4-4 in FIG. 3.
Figure 3:
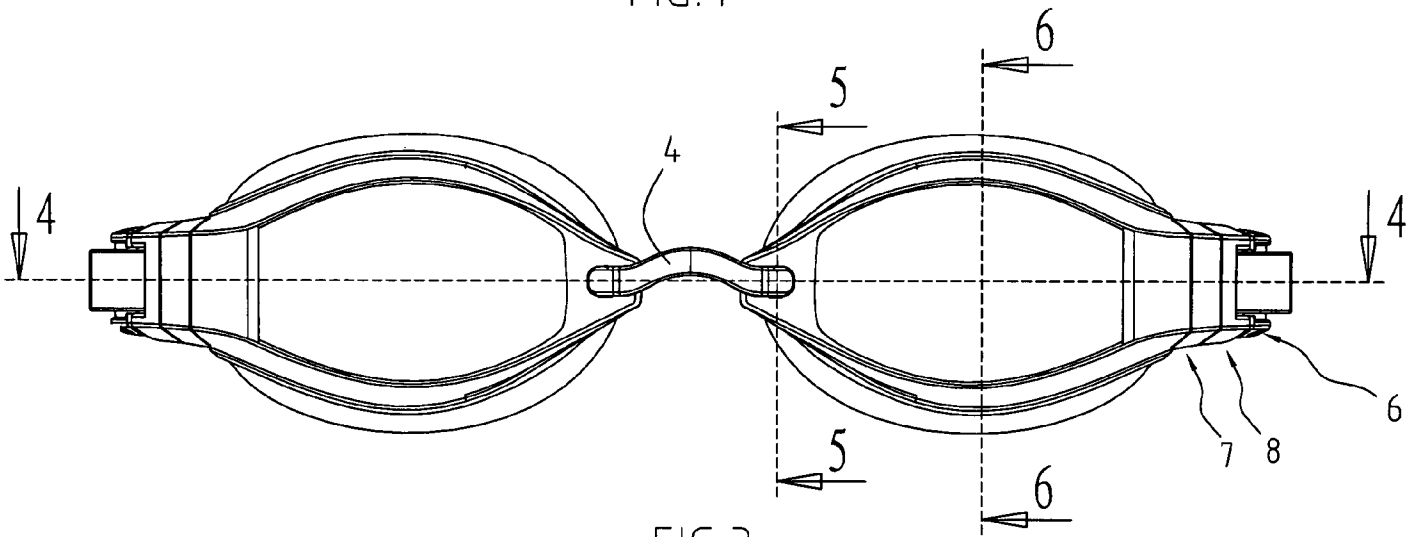
FIG. 3 is a front view of the swimming goggles of FIG. 2.
Figure 6:
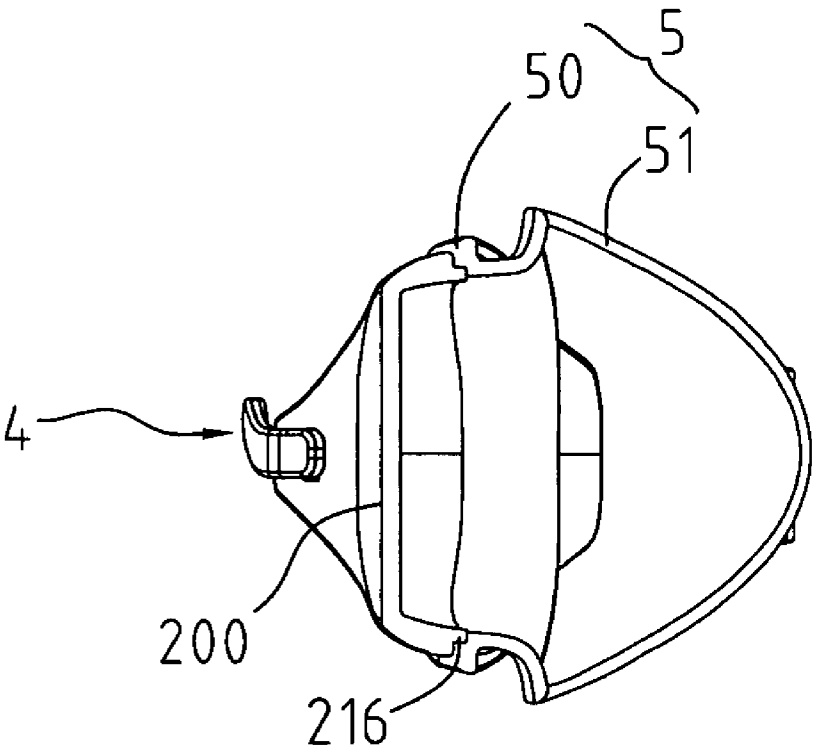
FIG. 6 is a cross-sectional view taken along the line 6-6 in FIG. 3.
Figure 5:
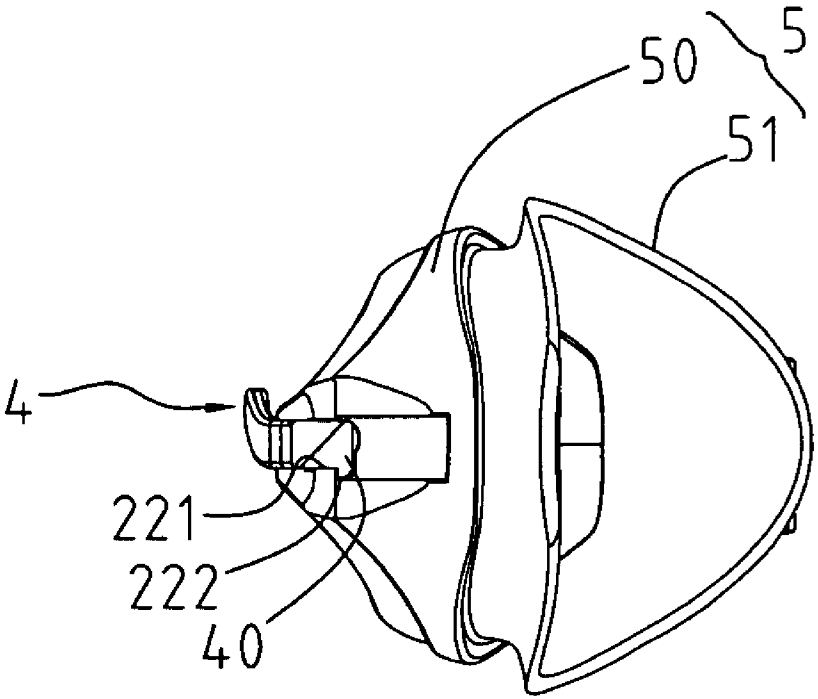
FIG. 5 is a cross-sectional view taken along the line 5-5 in FIG. 3.

With reference to FIGS. 1 to 6, swimming goggles 1 in accordance with the present invention comprise a left frame 2, a right frame 3, a connecting member 4 connecting the left frame 2 and the right frame 3, soft pads 5, a strap mechanism 6 (see FIG. 8) and control members 7. The left frame 2 and the right frame 3 are of the same structure, and are both made of Polypropylene (PP). The left frame 2 (the right frame 3) comprises a frame body 20 (30) and an lens 200 (300) which are integrally formed of hard material. A latch portion 21 (31) is formed on an outward side of the frame body 20 (30). According to one embodiment of the present invention, the latch portion 21 (31) comprises a neck portion 210 (310) unitarily extended from an outward side of the frame body 20 (30), and a first latch side 211 (311) and a second latch side 212 (312) traversing on the neck portion 210 (310) and opposite to each other. A first latch slot 213 (313) is formed between the neck portion 210 (310) and the first latch side 211 (311), and a second latch slot 214 (314) is formed between the neck portion 210 (310) and the second latch side 212 (312). A latch post 215 (315) is formed on an edge of the first latch side 211 (311). An embedding groove 22 (32) is defined in an inward side of the frame body 20 (30). Also referring to FIG. 4, the embedding groove 22 (32) includes an entry 221 (321) and a turning cavity 222(322) for assembling with the connecting member 4. A flange 216 (316) is formed on the frame body 20 (30) and adjacent to a user's face when being worn, and has stepped cross section for reinforcing assembly with the pads 5.

The pads 5 are made of thermal plastic rubber (TPR), and comprises an enveloping portion 50 and a touching portion 51. The enveloping portion 56 envelopes the flange 216 (316) and extends to the turning cavity 222 (322) of the embedding groove 22 (32) for clamping firmly. The touching portion 51 has a bugle shape for touching a user's face comfortably.

The connecting member 4 includes embedding portions respectively on both ends thereof, and assembling arms 40 unitarily formed therewith for extending into the entries 221, 321. The assembling arms 40 offset appropriate angles, for example 90 degree, relative to the entries 221, 321 when assembled. During assembly, the assembling arms 40 are mounted on the entries 221, 321, and turn 90 degree such that the assembling arms 40 abut against inner walls of the turning cavities 222, 322 (see FIG. 4), whereby the left frame 2 and the right frame 3 are connected to the connecting member 4 fixedly.

Figure 8:
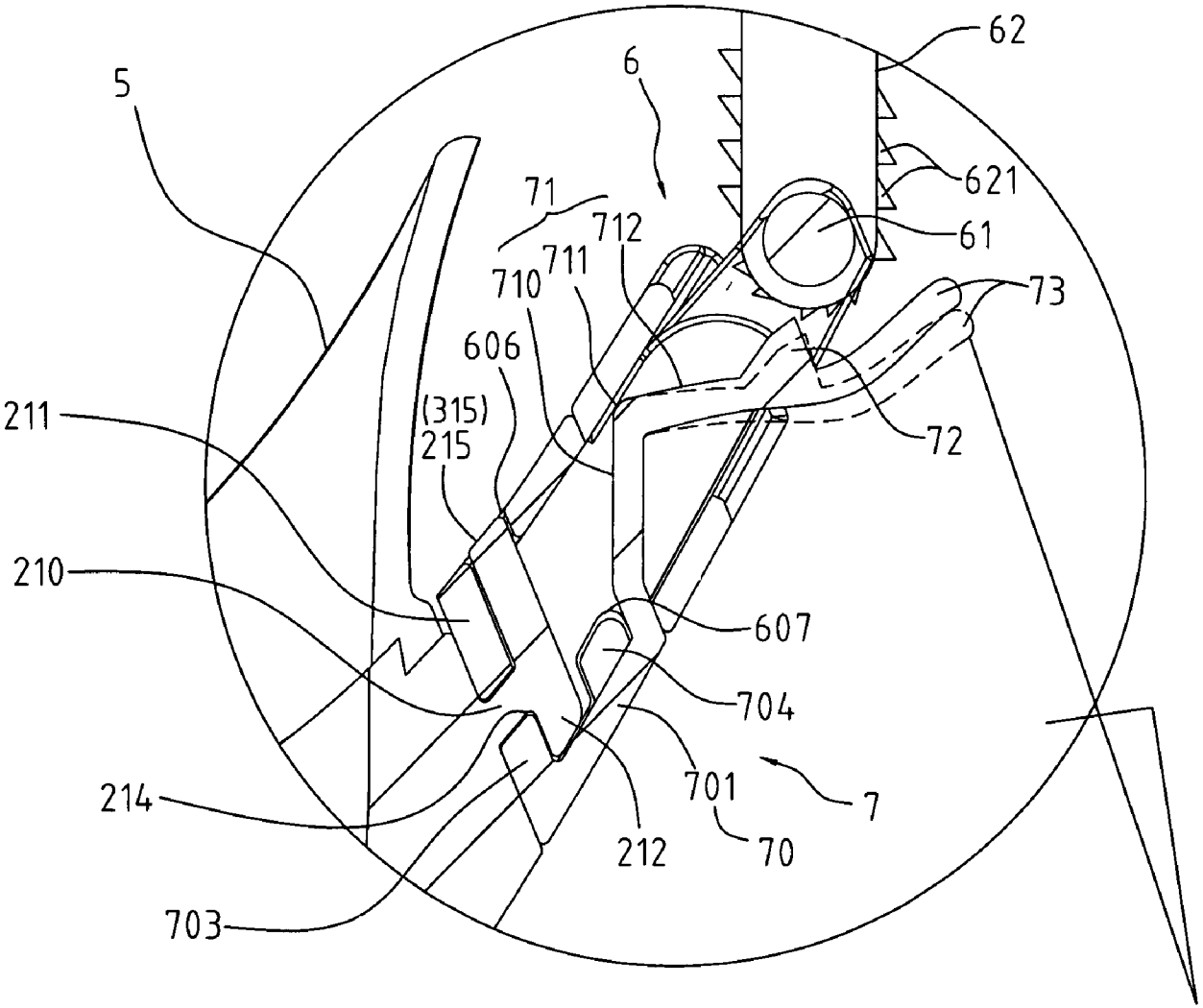
FIG. 8 is a partially enlarged view of the swimming goggles, especially showing a head strap thereof being adjusted in length.

The strap mechanism 6 is assembled on the latch portions 21, 31 of the left frame 2 and the right frame 3, and comprises bases 60, positioning axes 61 and a head strap 62 (see FIG. 8). Each base 60 comprises a pair of branches 601 parallel to each other, assembling surfaces 602 and lock surfaces 603. The braches 601 form first axis holes 604 in ends thereof for assembling the positioning axes 61. The assembling surfaces 602 respectively correspond to the first latch sides 211, 311 and the second latch sides 212, 312. Openings 605 are defined in the assembling surfaces 602 for engaging with the first latch sides 211, 311. The lock surfaces 603 are formed adjacent to the assembling surfaces 602, and form lock portions for locking with the latch posts 215, 315 of the latch portions 21, 31. According to one embodiment of the present invention, the lock portions comprise lock grooves 606 (see FIG. 4) in the lock surfaces 603 for locking with the latch posts 215, 315 of the latch portions 21, 31. When assembled, the first latch sides 211, 311 are assembled with the openings 605 of the assembling surfaces 602. The assembling surfaces 602 are received in the first latch slots 213, 313, and the latch posts 215, 315 lock with the lock grooves 606. The braches 601 define lock notches 607 for engaging with the control members 7. The positioning axes 61 are retained on the first axis holes 604 of the bases 60. The head strap 62 wraps the positioning axes 61 and defines a plurality of stop grooves 621 therein.

The control members 7 are respectively assembled on the latch portions 21, 31 of the left frame 2 and the right frame 3, and abut against the lock surfaces 603 of the strap mechanism 6. Each control member 7 comprises an engaging portion 70 for engaging with the latch portion 21(31) of the left frame 2 and the right frame 3, an operating portion 73, a pivot portion 71 between the engaging portion 70 and the operating portion 73, and a bias portion 72. The engaging portion 70 is U-shaped, and includes a central wall 701 and a pair of side walls 702. A lock wall 703 is formed on the central wall 701 for latching with the second latch slots 214, 314. Tabs 704 are formed on the side walls 702 for locking with the lock notches 607 of the strap mechanism 6.

The pivot portion 71 unitarily extends from a side of the central wall 701 and opposite to the lock wall 703. The pivot portion 71 is V-shaped, and includes a connecting side 710, an extension side 712, and an intermediate side 711 between the connecting side 710 and the extension side 712. The connecting side 710 is integrated with the central wall 701. The intermediate side 711 abuts against the lock surfaces 603 of the strap mechanism 6, and serves as a fulcrum of leverage. The bias portion 72 includes barbs formed on the extension side 712 of the pivot portion 71 and near a side of the operating portion for abutting against the stop grooves 621 of the head strap 62. The operating portion 73 is oriented opposite to the engaging portion 70. In other words, the operating portion 73 is an appropriate length unitarily extended from a side of the extension side 712 of the pivot portion 71 for manual operation. When the operating portion 73 is pushed inward (see FIG. 8), the bias portion 72 displaces inward correspondingly, and disengages from the stop groove 621. Deformation of the operating portion 73 provides return force thereof.

Sheath members 8 are assembled on the branches 601 of the bases 60, and are juxtaposed with the engaging portions 70 of the control members 7 for limiting the operating portions 73.

Figure 7:
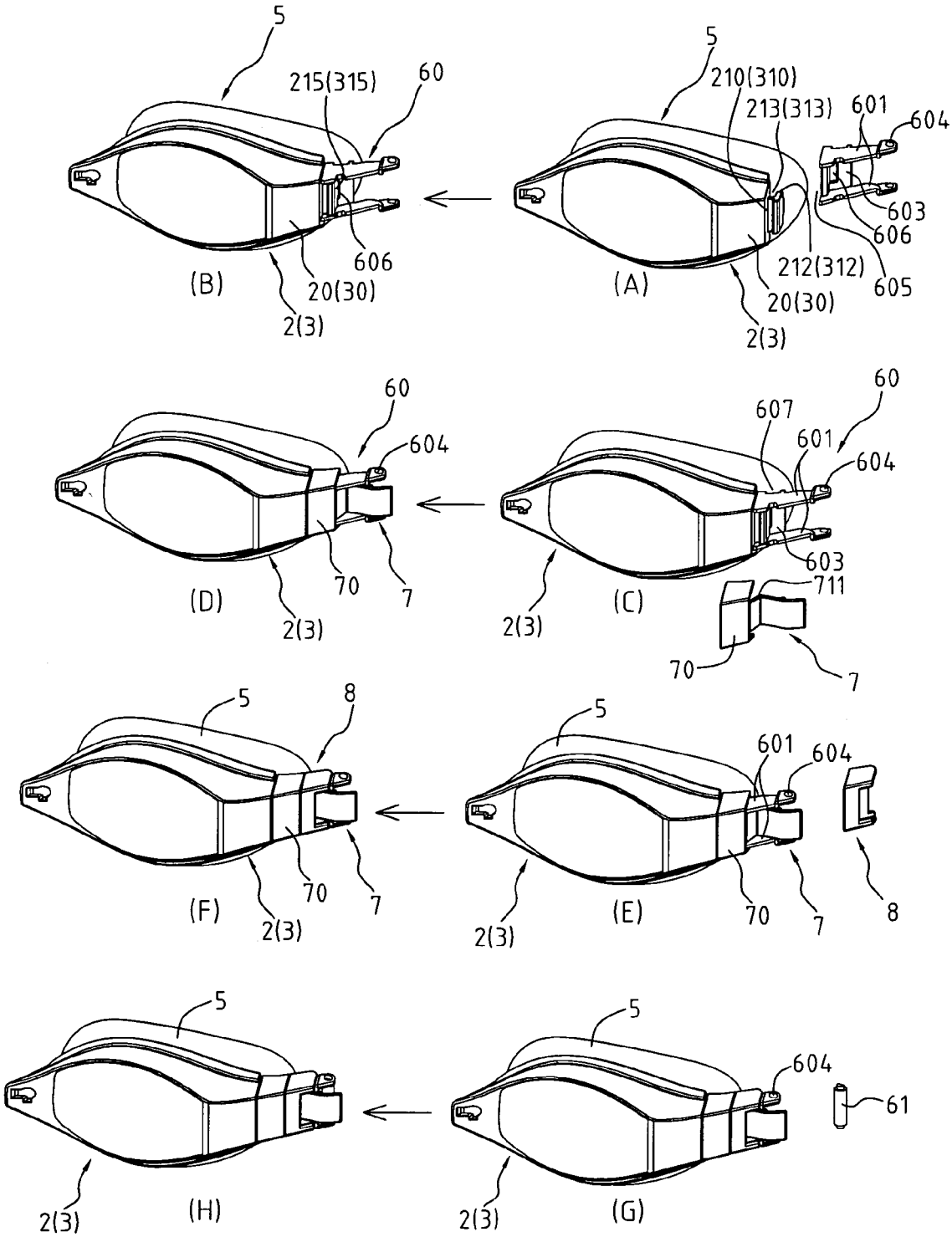
FIGS. 7A-7H illustrate the swimming goggles being assembled step by step.

In assembly, referring to FIGS. 7A-7G, the left frame 2, the right frame 3 and the pads 5 are combined together. The second latch sides 212, 312 of the left frame 2 and the right frame 3 are assembled on the openings 605 of the bases 60 (see FIG. 7A). As shown in FIG. 7B, the assembling surfaces 602 are received in the first latch slots 213, 313, and the latch posts 215, 315 lock with the lock grooves 606. Referring to FIGS. 7C and 7D, the tabs 704 (see FIG. 1) of the control members 7 lock with the lock notches 607 of the bases 60. The intermediate sides 711 abut against the lock surfaces 603 of the bases 60, serving as a fulcrum of leverage. The sheath members 8 are assembled with the branches 601 of the bases 6 and are juxtaposed with the engaging portions 70 of the control members 7. Finally, as shown in FIGS. 7G and 7H, the positioning axes 61 are assembled on the first axis holes 604. Finally, the left frame 2, the right frame 3, the strap mechanisms 6, the control members 7 and the sheath member 8 are assembled together.

Referring to FIG. 8, in use, in order to adjust the head strap 62, the operating portions 73 of the control members 7 are pushed inwardly (shown as the arrow) to disengage the bias portions 72 from the stop groove 621 of the head strap 62. Meanwhile the operating portions 73 are deformed to provide return force. The operating portions 73 go back by reserved deformation energy once released.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

a left frame and a right frame, each of the left frame and the right frame having a frame body and a lens, the frame body forming a latch portion on an outward side thereof, each latch portion comprising a neck portion unitarily extended from an outward side of the frame body, and a first latch side and a second latch side traversing on the neck portion and opposite to each other, a first latch slot being formed between the neck portion and the first latch side, and a second latch slot being formed between the neck portion and the second latch side, a latch post being formed on an edge of the first latch side;

a connecting member connecting the left frame and the right frame;

a strap mechanism being assembled on the latch portions of the left frame and the right frame, and including bases, positioning axes and a head strap, the positioning axes being mounted on the bases, the head strap defining a plurality of stop grooves therein, each of the bases forming a pair of branches parallel to each other, assembling surfaces and lock surfaces, first axis holes being defined in ends of the branches for assembling with the positioning axes, lock notches being defined in the branches, the assembling surfaces respectively corresponding to the first latch sides and the second latch sides, openings being defined in the assembling surfaces for engaging with the first latch sides, the lock surfaces being formed adjacent to the assembling surface, and comprising lock grooves therein for locking with the latch posts of the latch portions; and control members being respectively assembled on the latch portions of the left frame and the right frame and abutting against the bases of the strap mechanism, each control member comprising an engaging portion for engaging with the latch portion of the left frame/the right frame, an operating portion formed opposite to the engaging portion, a pivot portion provided between the engaging portion and the operating portion for abutting the bases of the strap mechanism, and a bias portion near a side of the operating portion for abutting against the stop grooves of the head strap, the engaging portion being U-shaped, and including a central wall and a pair of side walls, a lock wall being formed on the central wall for latching with the second latch slots, tabs being formed on the side walls for locking with the lock notches of the strap mechanism;

wherein when the operating portion is pushed inward, the bias portion displaces inward correspondingly and disengages from the stop groove, the operating portion having return force by deformation, and when being assembled, the first latch sides are assembled with the openings of the assembling surfaces, the assembling surfaces are received in the first latch slots, the latch posts locking with the lock grooves.

2. The swimming goggles as claimed in claim 1, wherein the pivot portion unitarily extends from a side of the central wall and opposite to the lock wall, the pivot portion being V-shaped and including a connecting side, an intermediate side and an extension side, the connecting side being integrated with the central wall, the intermediate side abutting against the lock surfaces of the strap mechanism and serving as a fulcrum of leverage.

3. The swimming goggles as claimed in claim 2, wherein the bias portion includes barbs formed on the extension side of the pivot portion for abutting against the stop grooves of the head strap.

4. The swimming goggles as claimed in claim 3, wherein the operating portion is a length unitarily extended from the extension side of the pivot portion for manual operation.

5. The swimming goggles as claimed in claim 4, further comprising sheath members assembled on the branches of the bases, the sheath members being juxtaposed with the engaging portions of the control members for limiting the operating portions.

6. The swimming goggles as claimed in claim 1, wherein embedding grooves are defined in the frame bodies, and the connecting member forms embedding portions thereon for engaging with the embedding grooves thereby assembling the connecting member with the frame bodies, and wherein each embedding groove includes an entry and a turning cavity, assembling arms are unitarily formed on the connecting member for extending into the entries, the assembling arms offset angles relative to the entries when assembled, during assembling, the assembling arms being mounted on the entries, and turning a degree such that the assembling arms abut against inner walls of the turning cavities.

7. The swimming goggles as claimed in claim 6, wherein the assembling arms offset 90 degree relative to the entries.

8. The swimming goggles as claimed in claim 6, further comprising pads on sides of the left frame and the right frame and adjacent to a user's face in use, the pads being made of thermal plastic rubber (TPR), and comprising an enveloping portion enveloping the frame bodies of the left frame and the right frame, and a bugle-shaped touching portion for touching a user's face comfortably.

9. The swimming goggles as claimed in claim 8, wherein flanges are formed on the frame bodies and adjacent to a user's face when being worn, and have stepped cross sections for reinforcing assembly with the pads, the enveloping portions of the pads enveloping the flanges, and extending to the turning cavities for clamping firmly.

10. Swimming goggles comprising:

a left frame and a right frame, each of the left frame and the right frame having a frame body and a lens, the frame body forming a latch portion on an outward side thereof, each latch portion comprising a neck portion unitarily extended from an outward side of the frame body, and a first latch side and a second latch side traversing on the neck portion and opposite to each other, a first latch slot being formed between the neck portion and the first latch side, and a second latch slot being formed between the neck portion and the second latch side, a latch post being formed on an edge of the first latch side;

a connecting member connecting the left frame and the right frame;

a strap mechanism being assembled on the latch portions of the left frame and the right frame, and including bases, positioning axes and a head strap, the positioning axes being mounted on the bases, the head strap defining a plurality of stop grooves therein, each of the bases forming a pair of branches parallel to each other, assembling surfaces and lock surfaces, first axis holes being defined in ends of the branches for assembling with the positioning axes, lock notches being defined in the branches, the assembling surfaces respectively corresponding to the first latch sides and the second latch sides, openings being defined in the assembling surfaces for engaging with the first latch sides, the lock surfaces being formed adjacent to the assembling surface, and comprising lock grooves therein for locking with the latch posts of the latch portions; and control members being respectively assembled on the latch portions of the left frame and the right frame and abutting against the bases of the strap mechanism, each control member comprising an engaging portion for engaging with the latch portion of the left frame/the right frame, an operating portion formed opposite to the engaging portion, a pivot portion provided between the engaging portion and the operating portion for abutting the bases of the strap mechanism, and a bias portion near a side of the operating portion for abutting against the stop grooves of the head strap;

wherein when the operating portion is pushed inward, the bias portion displaces inward correspondingly and disengages from the stop groove, the operating portion having return force by deformation, and when being assembled, the first latch sides are assembled with the openings of the assembling surfaces, the assembling surfaces are received in the first latch slots, the latch posts locking with the lock grooves, embedding grooves are defined in the frame bodies, and the connecting member forms embedding portions thereon for engaging with the embedding grooves thereby assembling the connecting member with the frame bodies, and wherein each embedding groove includes an entry and a turning cavity, assembling arms are unitarily formed on the connecting member for extending into the entries, the assembling arms offset angles relative to the entries when assembled, during assembling, the assembling arms being mounted on the entries, and turning a degree such that the assembling arms abut against inner walls of the turning cavities.

* * * * *